US008181680B1

(12) United States Patent
Clark

(10) Patent No.: US 8,181,680 B1
(45) Date of Patent: May 22, 2012

(54) MACHINERY FENCE SUPPORT FACILITATING FENCE MOVEMENT IN A DIRECTION PERPENDICULAR TO A LENGTH OF THE FENCE

(75) Inventor: Scott L. Clark, Boone, IA (US)

(73) Assignee: Allen IP Inc., Huxley, IA (US)

( * ) Notice: Subject to any disclaimer, the term of this patent is extended or adjusted under 35 U.S.C. 154(b) by 197 days.

(21) Appl. No.: 12/754,203

(22) Filed: Apr. 5, 2010

Related U.S. Application Data

(60) Provisional application No. 61/166,576, filed on Apr. 3, 2009.

(51) Int. Cl.
*B27C 5/00* (2006.01)

(52) U.S. Cl. ..... 144/241

(58) Field of Classification Search ..... 144/241; 408/1 BD; 125/1; 7/158
See application file for complete search history.

(56) References Cited

U.S. PATENT DOCUMENTS

| | | | | |
|---|---|---|---|---|
| 3,737,245 | A * | 6/1973 | Mater | 408/225 |
| 5,097,555 | A * | 3/1992 | Dwyer | 7/158 |
| 7,226,257 | B2 * | 6/2007 | Lowder et al. | 409/180 |
| 7,464,737 | B2 | 12/2008 | Duginske | |
| 7,543,661 | B2 * | 6/2009 | Griffo et al. | 175/375 |
| 7,591,616 | B1 * | 9/2009 | Kerner | 408/124 |
| 2009/0053002 | A1 * | 2/2009 | Kirby | 408/1 BD |

OTHER PUBLICATIONS

Web site: Amana Tool® "Constructing a Beaded Face Frame" by Lonnie Bird, accessed Mar. 4, 2009, 2 pp., http://www.amanatool.com/articles/Constructing_a_Beaded_Face_Frame.html.

Web site: Hoffman, Morso NLEH Series: Automatic Guillotine for Beaded Face Frames, accessed Mar. 4, 2009, 4 pp., http://www.hoffmann-usa.com/htm/beaded_face_frames/morso_nleh.htm.

Web site: Hoffman, Introduction to the Beaded Face Frame System, accessed Mar. 4, 2009, 2 pp., http://www.hoffmann-usa.com/htm/beaded_face_frames/intro_beaded_face_frames.htm.

Web site: Woodweb, Jig for beaded faceframes: Photographs of a shop-built jib, Jun. 4 2003, 4 pp., http://www.woodweb.com/knowledge_base/Beaded_Face_Frame_Fabrication.html.

Web site: JessEm Tool Company, New Product, Mite-R-Slide™, accessed Dec. 1, 2008, 2 pp., http://www.jessem.com/MITE-R-SLIDE.html.

Web site: Woodweb, Discussion: Beaded Face Frame Fabrication, Jan. 24, 2005, 6 pp., http://www.woodweb.com/knowledge_base/Beaded_Face_Frame_Fabrication.html.

* cited by examiner

*Primary Examiner* — Shelley Self
(74) *Attorney, Agent, or Firm* — Zarley Law Firm, P.L.C.

(57) ABSTRACT

In one example, a machinery fence support system comprises a base providing a substantially stationary position relative to a cutting tool; a moveable fence for guiding a workpiece relative to the cutting tool, and a linear motion mechanism between the base and the fence. The linear motion mechanism facilitates motion of the fence in a direction substantially perpendicular to a length of the fence. Examples of this disclosure facilitate notching a workpiece for a beaded face frame using a rotary bit.

14 Claims, 7 Drawing Sheets

MACHINERY FENCE SUPPORT FACILITATING FENCE MOVEMENT IN A DIRECTION PERPENDICULAR TO A LENGTH OF THE FENCE

This application claims priority from U.S. Provisional Application Ser. No. 61/166,576, titled, "MACHINERY FENCE SUPPORT FACILITATING FENCE MOVEMENT IN A DIRECTION PERPENDICULAR TO A LENGTH OF THE FENCE," and filed Apr. 3, 2009, the entire content of which is incorporated herein by reference.

TECHNICAL FIELD

This disclosure relates to jigs or fixtures for positioning, aligning, guiding, and/or holding a workpiece during a cutting or shaping operation.

BACKGROUND

Beaded face frames are face frames including molded features along interior edges of the frame, such as edges around openings of the face frame. One technique to produce beaded face frames is to build face frames with square stock and then apply separate bead molding to interior edges of the completed face frame. This technique requires the ends of the each molding piece to be miter cut to exact lengths according to the length of the corresponding edge of the face frame. The molding pieces may be secured to the face frames using nails, glue or both. If nails are used, nail holes are preferably filled and sanded after securing the molding to the face frame.

Alternatively, beaded stock can be used. However, assembling beaded stock pieces to create a beaded face frame requires precisely notching out the bead of a workpiece to receive abutting workpieces. In addition, the beads of the abutting workpieces must be miter cut to align with the beads of the workpiece including the corresponding notch.

SUMMARY

In general, this disclosure relates to techniques for notching a workpiece for a beaded face frame using a rotary bit. In particular techniques include using a rotary bit having a profile of notch suitable for a beaded face frame with a machinery fence support system including a linear motion mechanism that facilitates motion of the fence in a direction substantially perpendicular to a length of the fence In an example, a machinery fence support system comprises a base providing a substantially stationary position relative to a cutting tool; a moveable fence for guiding a workpiece relative to the cutting tool, and a linear motion mechanism between the base and the fence. The linear motion mechanism facilitates motion of the fence in a direction substantially perpendicular to a length of the fence.

In another example, a machinery fence support system comprises a worktable providing a substantially stationary support relative to a cutting tool, a track fixed to the worktable, a base adjustably mounted to the track, a fence configured to support a workpiece during a cutting operation, and a set of linear bearings between the base and the fence to facilitate motion of the fence in a direction substantially perpendicular to a length of the fence.

In another example, a rotary bit for cutting a workpiece for a beaded face frame comprises a shaft for securing the rotary bit, and a cutting element fixed to an end of the shaft, the cutting element having a symmetric trapezoidal profile. The side of the profile of the cutting element proximate to the shaft is longer than the distal side of the profile of the cutting element, and the profile of the cutting element corresponds to the shape of a notch in the workpiece for receiving an abutting workpiece.

In another example, a method of notching a workpiece for a beaded face frame comprises obtaining a machinery fence support system. The machinery fence support system comprises a worktable providing a substantially stationary support relative to a router, a track fixed to the worktable, a base adjustably mounted to the track, a moveable fence for guiding the workpiece relative to the router, and a linear motion mechanism between the base and the fence. The linear motion mechanism facilitates motion of the fence in a direction substantially perpendicular to a length of the fence. The method further comprises mounting a rotary bit for cutting the workpiece for the beaded face frame in the router, securing the workpiece to the fence, and using the linear motion mechanism to move the fence and the workpiece over the rotary bit to cut the notch in the workpiece.

The details of one or more examples of this disclosure are set forth in the accompanying drawings and the description below. Other features, objects, and advantages of this disclosure will be apparent from the description and drawings, and from the claims.

DETAILED DESCRIPTION

Figure 1:
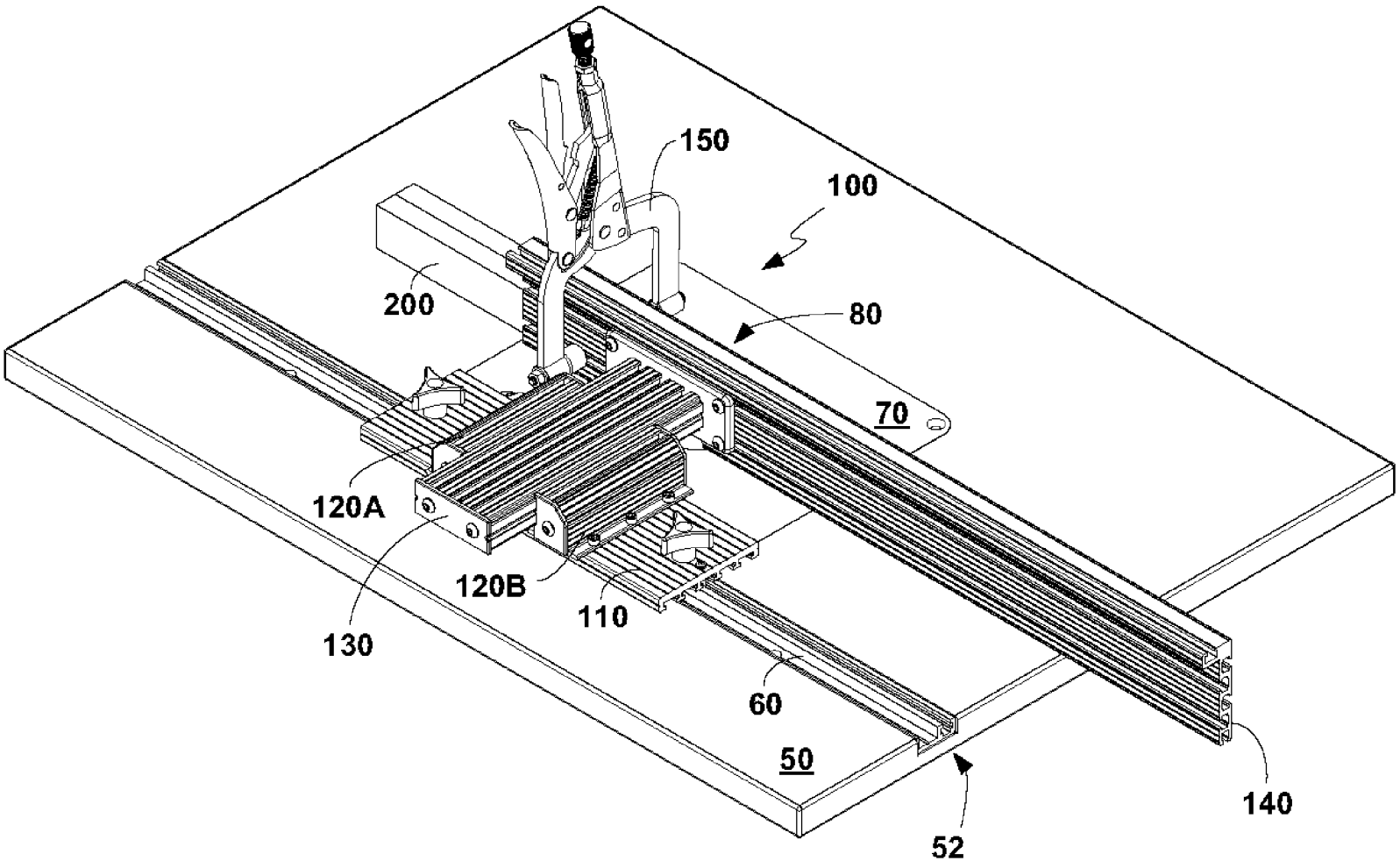
FIG. 1 illustrates an assembly including a worktable, a router and a machinery fence support system.
Figure 2:
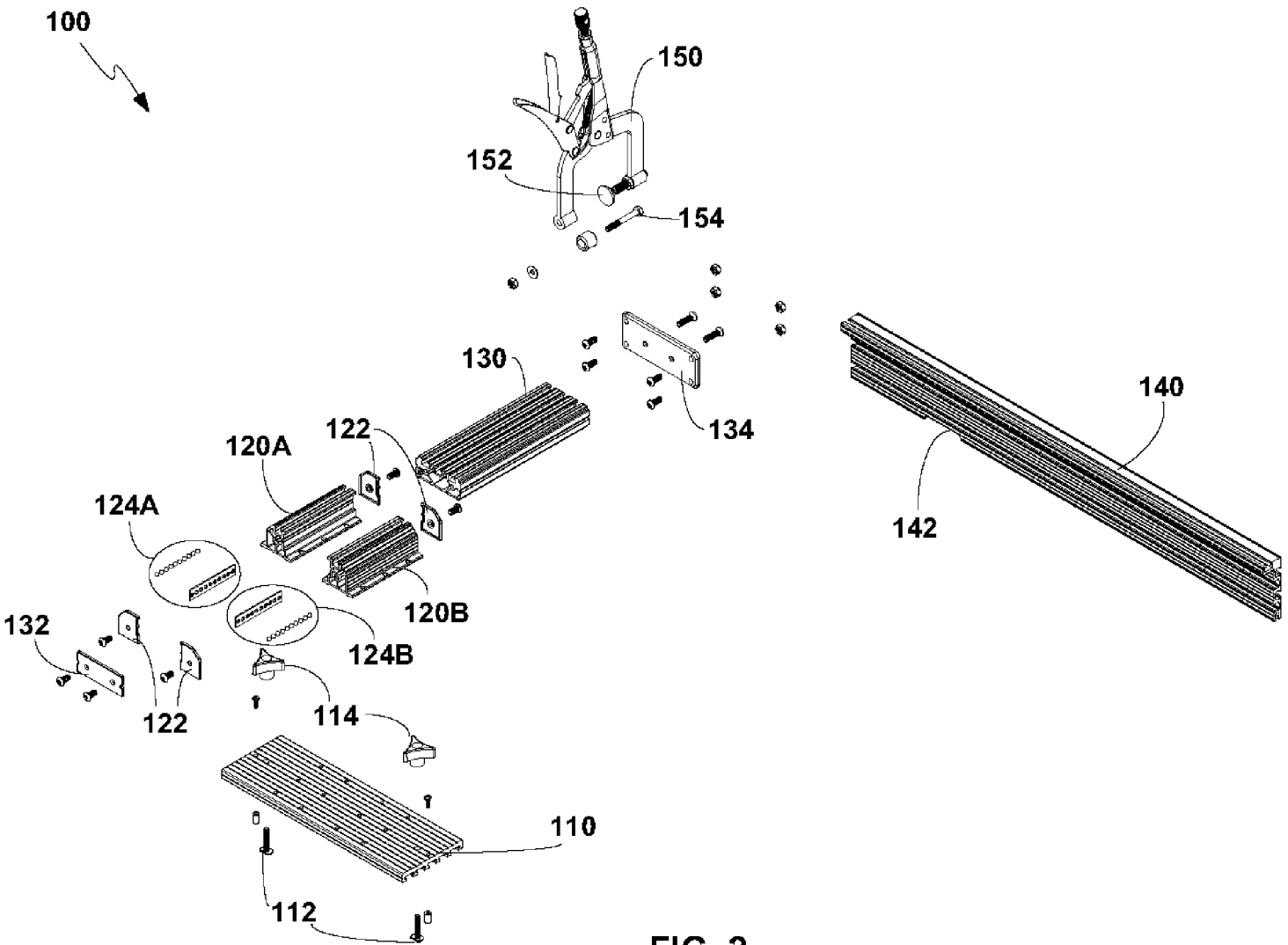
FIG. 2 is an exploded view of the machinery fence support system shown in FIG. 1.
Figure 3:
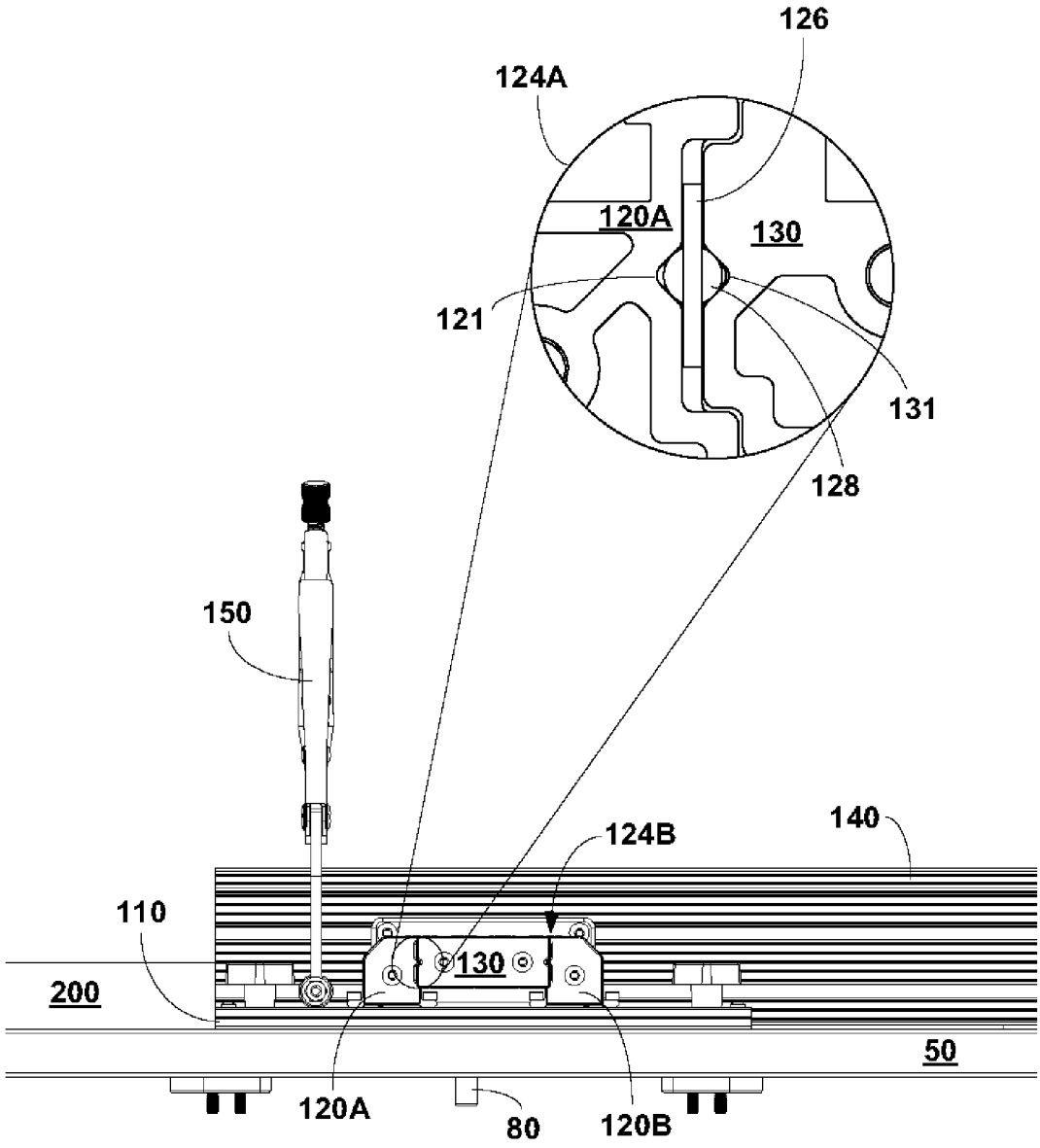
FIG. 3 is a side view of the machinery fence support system shown in FIGS. 1-2 and includes a close-up view illustrating a linear bearing of the machinery fence support system.

FIG. 1 illustrates an assembly including worktable 50, a router including rotary bit 80, and machinery fence support system 100. Machinery fence support system 100 includes base 110, stationary bearing supports 120A, 120B (collectively "stationary bearing supports 120") and moveable bearing support 130, fence 140 and clamp 150. FIG. 2 illustrates an exploded view of machinery fence support system 100. In addition, FIG. 3 illustrates a side view of the machinery fence support system 100.

Worktable 50 includes recess 52. Track 60 is securely mounted within recess 52 such that the top surface of track 60 is no higher than the work surface of worktable 50. Worktable 50 also includes insert plate 70, which may be suitable to provide precisely flat and level worksurface adjacent to rotatable bit 80. In addition, insert plate 70 is removable and facilitates access to the router mounted below worktable 50.

Fence 140 is configured to support workpiece 200 during a cutting operation using rotatable bit 80. Clamp 150 is secured to fence 140 opposite a workpiece support surface of fence 140 via bolt 154. Bolt 154 allows the position of clamp 150 relative to fence 140 to be adjusted. Clamp 150 includes a clamping face 152 (FIG. 2). As shown in FIG. 1, workpiece 200 is compressibly secured between clamping face 152 and the workpiece support surface of fence 140.

Fence 140 is moveably secured to worktable 50 via base 110. As best illustrated in FIG. 2, base 110 is adjustably mounted to track 60 using T-bolts 112 and thumb screws 114. Other fixation mechanisms may also be used. As one example, hand-actuated cam mechanisms could be used to secure base 110 to track 60 instead of thumb screws 114. Preferably, base 110 is positioned such that recess 142 (FIG. 2) lines up with rotary bit 80 when fence 140 is actuated. In this manner, recess 142 is configured to allow fence 140 to pass over rotary bit 80 without contact between fence 140 and rotary bit 80.

Linear bearings 124 facilitate motion of fence 140 in a direction substantially perpendicular to a length of fence 140. Linear bearings 124 each include a set of ball bearings as well as a guide plate including a hole for each ball bearing in the set to hold the corresponding ball bearing in place relative to the guide plate (best shown in FIG. 2). The ball bearings interface between stationary bearing supports 120A, 120B (collectively "stationary bearing supports 120") and moveable bearing support 130. This relationship is best shown in FIG. 3, which illustrates in the close-up view of linear bearing 124A. In linear bearing 124A, guide plate 126 holds bearing 128 in place between stationary bearing support 120A and moveable bearing support 130. As also visible in the close-up view of linear bearing 124A, stationary bearing support 120A includes a groove 121 with two bearing support surfaces, and moveable bearing support 130 includes a groove 131 with two additional bearing support surfaces. For example, grooves 121, 131 may each be approximately right-angled grooves. The ball bearings in linear bearings 124 are each operable to simultaneously contact one of the bearing support surfaces on each of grooves 121, 131 such that linear bearings 124 facilitate a smooth and precise linear motion of moveable bearing support 130 and fence 140 relative to stationary bearing supports 120, base 110 and worktable 50.

Stationary bearing supports 120 each include two endcaps 122 to hold the guide plates of linear bearings 124 in place. Likewise, moveable bearing support 130 includes endcap 132, which prevents moveable bearing support 130 from traveling off one end of stationary bearing supports 120 such that any of the ball bearings of linear bearings 124 could fall out. On the other end of moveable bearing support 130, opposite endcap 132, mounting plate 134 performs the dual function of securing fence 140 to moveable bearing support 130 and as well as preventing the over travel of moveable bearing support 130 in the other direction.

The two linear bearings 124 combine to substantially limit the motion of moveable bearing support 130 and fence 140 relative to stationary bearing supports 120 and base 110 along a straight line. For example, the configuration of the linear bearings 124 and the width of moveable bearing support 130, i.e., the distance between linear bearing 124A and linear bearing 124B, allows moveable bearing support 130 to be tightly constrained rather than being able to wiggle relative to base 110. This is important because if fence 140 were instead allowed to move in any significant amount in a direction that was not perpendicular to its length, the location of a notch cut in workpiece 200 by rotatable bit 80 would not necessarily be accurate. In addition, the notch itself would not necessarily match the profile of rotatable bit 80. As will be discussed in greater detail below, these features are important for cutting the precise notch necessary for a beaded face frame.

Linear bearings 124 constitute a linear motion mechanism. Other examples may include a different linear motion mechanism to facilitate motion of fence 140 in a direction substantially perpendicular to a length of 140. For example, such examples may include linear motion mechanisms requiring manual actuation like linear bearings 124, while other examples may include mechanically powered linear actuators. Examples of suitable linear motion mechanisms include mechanical actuators, hydraulic pistons, pneumatic pistons, four-bar linkage assemblies, a single linear bearing, recirculating ball slide bearings, a track system with a rolling carriage, any combination of these mechanisms, or a different linear motion mechanism. Other techniques suitable for providing linear motion include linear shafting with polymer or bronze type bearings.

Optionally, machinery fence support system 100 may also include an adjustable stop (not shown) mounted to fence 140 to facilitate precise positioning of workpiece 200 as is necessary to produce an accurately positioned notch in workpiece 200 suitable for building a beaded face frame. As examples, the adjustable stop may be a flip-stop and/or include an indicator that interacts with a ruler on fence 140 to indicate a position of the stop relative to fence 140. Stops suitable for use in conjunction with fence 140 are disclosed in U.S. Pat. No. 7,464,737, titled, "WOODWORKING MACHINERY STOP AND TRACK SYSTEM," the entire content of which is incorporated herein by reference.

While machinery fence support system 100 has been described as facilitating motion of fence 140 in a direction perpendicular to a length of fence 140, machinery fence support system 100 may optionally include a rotatable coupling mechanism between fence 140 and the linear motion mechanism. Such a rotatable coupling mechanism would combine with the linear motion mechanism to facilitate motion of fence 140 in multiple directions relative to the length of fence 140. This would allow angled notches with the profile of rotatable bit 80 to be cut in workpiece 200. In contrast, machinery fence support system 100 as shown in FIG. 1 only allows notches with the profile of rotatable bit 80 to be cut square in workpiece 200. Such a rotatable coupling mechanism may be adjustable to any desired angle and/or include positive stops corresponding to defined angles relative to the length of the fence.

Figure 4:
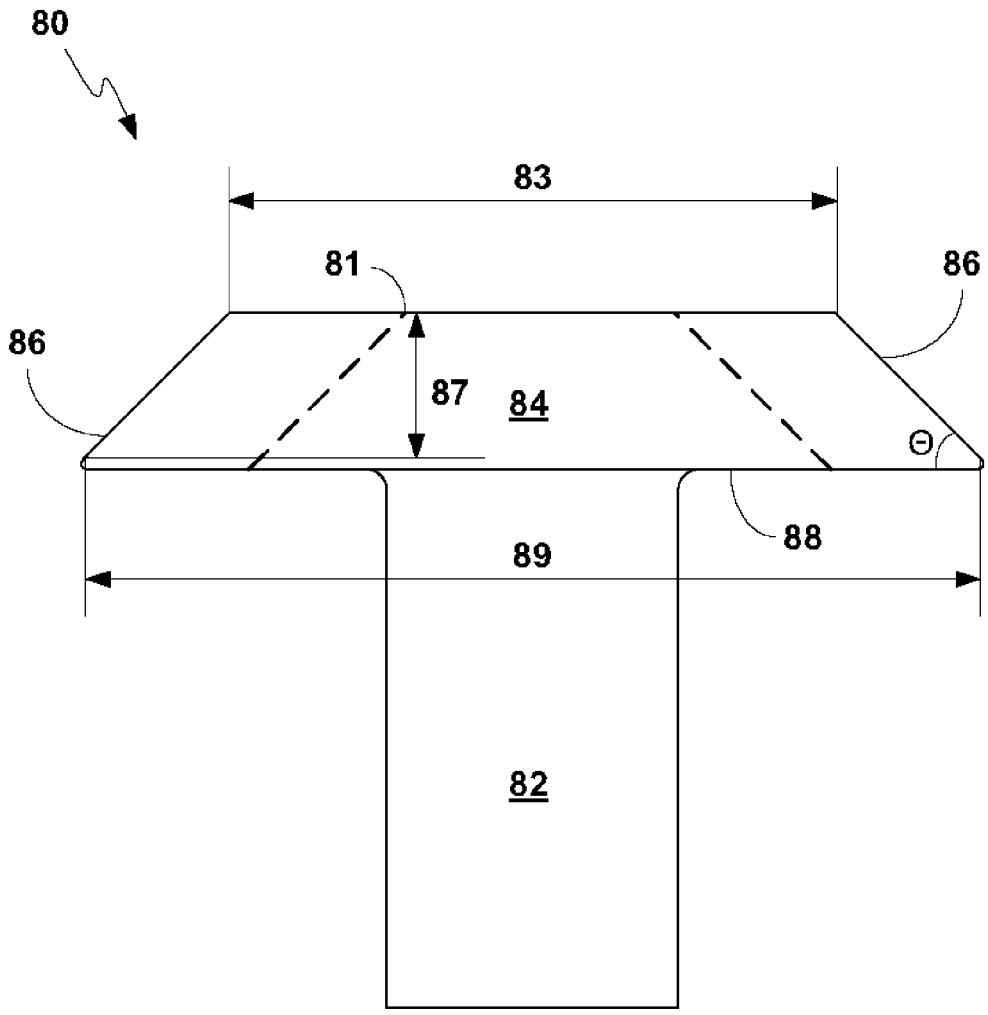
FIG. 4 illustrates a rotary bit for cutting a workpiece for a beaded face frame suitable for use in the machinery fence support system shown in FIGS. 1-3.

FIG. 4 illustrates a profile of rotary bit 80. Rotary bit 80 is suitable for cutting a workpiece for a beaded face frame. Rotary bit 80 includes shaft 82 and cutting element 84. Cutting element 84 has symmetric trapezoidal profile. The profile of cutting element 84 includes a cutting edge 86, distal side 81, which is distal relative to shaft 82 and proximate side 88, which is adjacent to shaft 82. The profile of cutting element 84 corresponds to the shape of a notch in a workpiece for receiving an abutting workpiece in a beaded face frame. For such an application, angle $\Theta$, the angle between proximate side 88 and cutting edge 86 is generally about forty-five degrees, but other angles may also be used, e.g., to build face frames with pieces that meet at angles different than ninety degrees.

Distal side 81 has a length 83. As an example, length 83 may be approximately equal to a width of a workpiece abutting a notch cut by rotary bit 80 in a beaded face frame, not including a width of beaded features along an edge of the abutting workpiece. As an example, length 83 may exceed 0.75 inches. As other examples, length 83 may exceed 1.0 inches, 1.5 inches, 2.0 inches, 2.5 inches or even 3.0 inches.

For example, length 83 may be about 0.75 inches, 1.0 inches, 1.5 inches, 2.0 inches, 2.5 inches, 3.0 inches or 3.25 inches.

Proximate side 88 has a length 83. As an example, length 89 may be equal to or greater than the width of the abutting workpiece in a beaded face frame. As an example, length 89 may exceed 1.0 inches. As other examples length 89 may exceed 1.5 inches, 2.0 inches, 2.5 inches, 3.0 inches or even 3.5 inches. For example, length 89 may be about 1.0 inches, 1.5 inches, 2.0 inches, 2.5 inches, 3.0 inches, 3.5 inches or 3.75 inches.

Height 87 of cutting element is at least as high as the width of beaded features along an edge of a workpiece. As an example, height 87 may be between 0 and 2 inches. As other examples, height 87 may be approximately 0.125 inches, 0.25 inches, 0.375 inches, 0.5 inches, 0.75 inches, 1.0 inch, 1.5 inches, 2.0 inches or another height. As discussed in greater detail with respect to FIG. 10, height 87 may be substantially similar to the width of a bead feature of a workpiece.

Figure 5C:
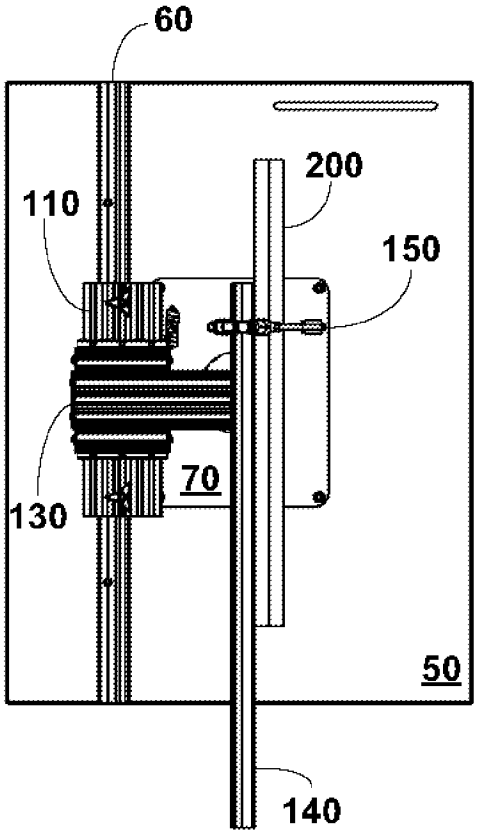
FIGS. 5A-5C are top views of the assembly of FIG. 1 and illustrate a cutting operation to notch a workpiece for a beaded face frame.
Figure 5B:
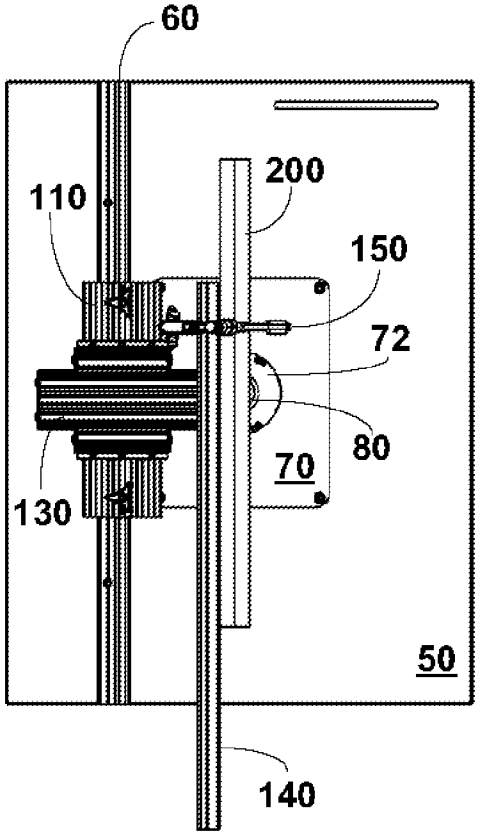
Figure 5A:
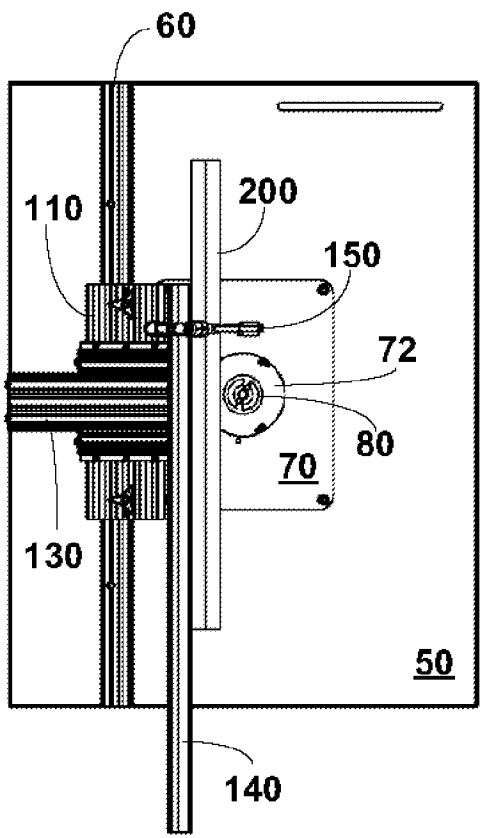

FIGS. 5A-5C are top views of the assembly of FIG. 1 and illustrate a cutting operation to notch workpiece 200 in a manner suitable for a beaded face frame. Worktable 50 provides a worksurface for the cutting operation. Insert plate 70 is mounted flush to worktable 50. Insert plate 70 includes a removable ring 72. Rotary bit 80 is mounted to a router below worktable 50 and protrudes from an aperture at the center of removable ring 72.

Base 110 is mounted to track 60. Fence 140 is secured to base 110 via moveable bearing support 130 and a linear motion mechanism as previously described herein.

As shown in FIG. 5A, workpiece 200 is secured to fence 140 with clamp 150. An operator (not shown) begins a cutting stroke by pushing fence 140, moveable bearing support 130 and workpiece 200 towards rotary bit 80 (FIG. 5B). As shown in FIG. 5C, the operator continues the cutting stroke until all of workpiece 200 has passed over rotary bit 80 such that a notch having the profile of the cutting element rotary bit 80 is cut into workpiece 200.

While not directly shown in FIGS. 5A-5C, cutting a notch into workpiece 200 for a beaded face frame also includes precisely positioning base 110 in track 60 as well as precisely positioning workpiece 200 relative to fence 140. For example, precisely positioning base 110 in track 60 may comprise zeroing the position of fence 140 relative to the axis of rotation of the router. For example, fence 140 may include a ruler, and base 110 may be positioned in track 60 such that the zero (0) position of the ruler lines up with the axis of rotation of the router. In addition, a stop may be mounted at a precise position along fence 140 corresponding to a desired position of the notch using the ruler and an indicator on the stop.

In addition, rotary bit 80 may be set to a desired height prior to a cutting operation. As an example, the height of the rotary bit relative to worktable 50 may be about equal to a width of beaded features along an edge of workpiece 200. Indeed, the height of the rotary bit relative to worktable 50 should be precisely equal to a width of beaded features along an edge of workpiece 200, e.g., the height of the rotary bit relative to worktable 50 may be within 0.005 inches or even within 0.001 inches of the width of beaded features along an edge of workpiece 200 to facilitate precise alignment of workpiece 200 with other workpieces used to build a face frame.

Furthermore, the assembly of FIG. 1 may be used to make mitered cuts to the beaded features on the ends of a workpiece. For such an operation, a workpiece such as workpiece 200 is securely positioned relative to fence 140 such that the end of workpiece 200 only passes over cutting edge 86 (FIG. 4) of rotary bit 80 and not over distal side 81 (FIG. 4) of rotary bit 80. For example, an additional stop may be secured to fence 140 for precisely positioning for mitered cuts to the beaded features on the ends of a workpiece without having to adjust the position of stop(s) used to precisely position the workpiece for cutting the notches.

Figure 6:
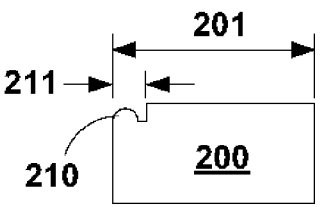
FIG. 6 illustrates a cross section of a workpiece having a bead.

FIG. 6 illustrates a cross section of workpiece 200, which includes bead 210. As shown in FIG. 6, workpiece 200 has a width 201, whereas bead 210 has a width 211.

Figure 7A:
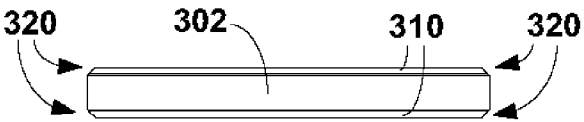
FIGS. 7A-7C illustrate a rail for a beaded face frame.
Figure 7B:
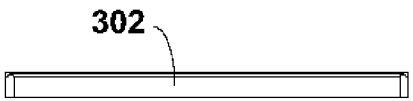
Figure 7C:
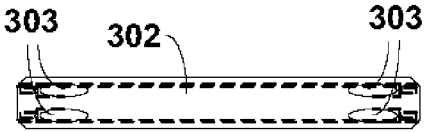

FIGS. 7A-7C illustrate top, side and bottom views respectively of center rail 302 for a beaded face frame. Rail 302 includes two beads 310. In contrast, top and bottom rails 306 (FIG. 9) only include a single bead. Mitered cuts 320 are located on the ends of beads 310. Mitered cuts 320 can be cut into a workpiece as discussed with respect to FIGS. 5A-5C.

Figure 9:
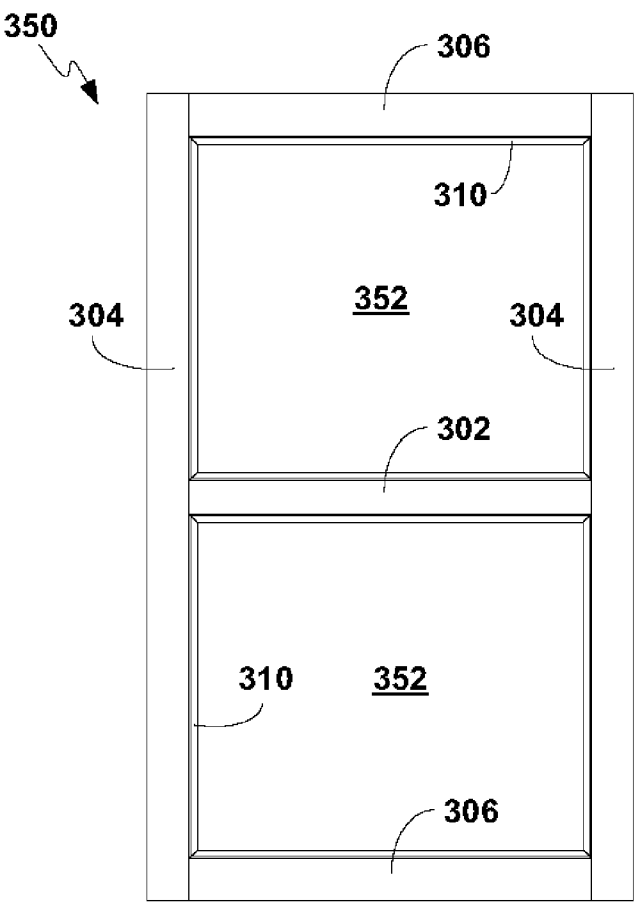
FIG. 9 illustrates an assembled beaded face frame including three rails and two stiles.

Rail 302 includes pocket holes 303, which may be used for fastening rail 302 to stiles 304 (FIG. 9) in beaded face frame 350 (FIG. 9). Other techniques for joining rail 302 to stiles 304 may also be used. These techniques include doweling, gluing, nailing, screwing, stapling, other suitable joining technique or any combination thereof.

Figure 8:
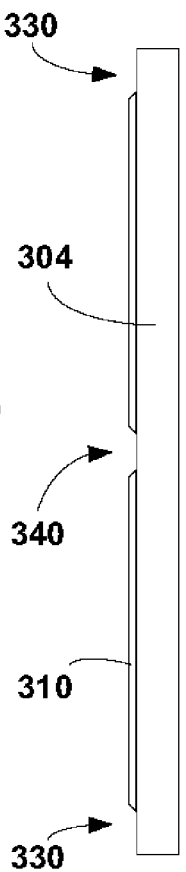
FIG. 8 illustrates a stile for a beaded face frame.

FIG. 8 illustrates stile 304 for a beaded face frame. Stile 304 includes a single bead 310. Partial notches 330 are located on the ends of bead 310, whereas full notch 340 is located in the center of bead 310. Partial notches 330 and full notch 340 can be cut into a workpiece as discussed with respect to FIGS. 5A-5C. For example, full notch 340 has the shape of the full profile of the top of rotary bit 80, whereas the shape of partial notches 330 only include a portion of the profile of the top of rotary bit 80.

FIG. 9 illustrates assembled beaded face frame 350. Assembled beaded face frame 350 includes center rail 302, top and bottom rails 306 and stiles 304. Rails 302, 306 are configured to mate with stiles 304 such that bead 310 forms a continuous loop around apertures 352 in beaded face frame 350. Specifically, partial notches 330 and full notch 340 in stiles 304 are configured to mate with the ends of rails 302, 306 including mitered cuts 320. Thus, beaded face frame 350 provides an aesthetically-pleasing finished look suitable for cabinetry and other applications.

Figure 10:
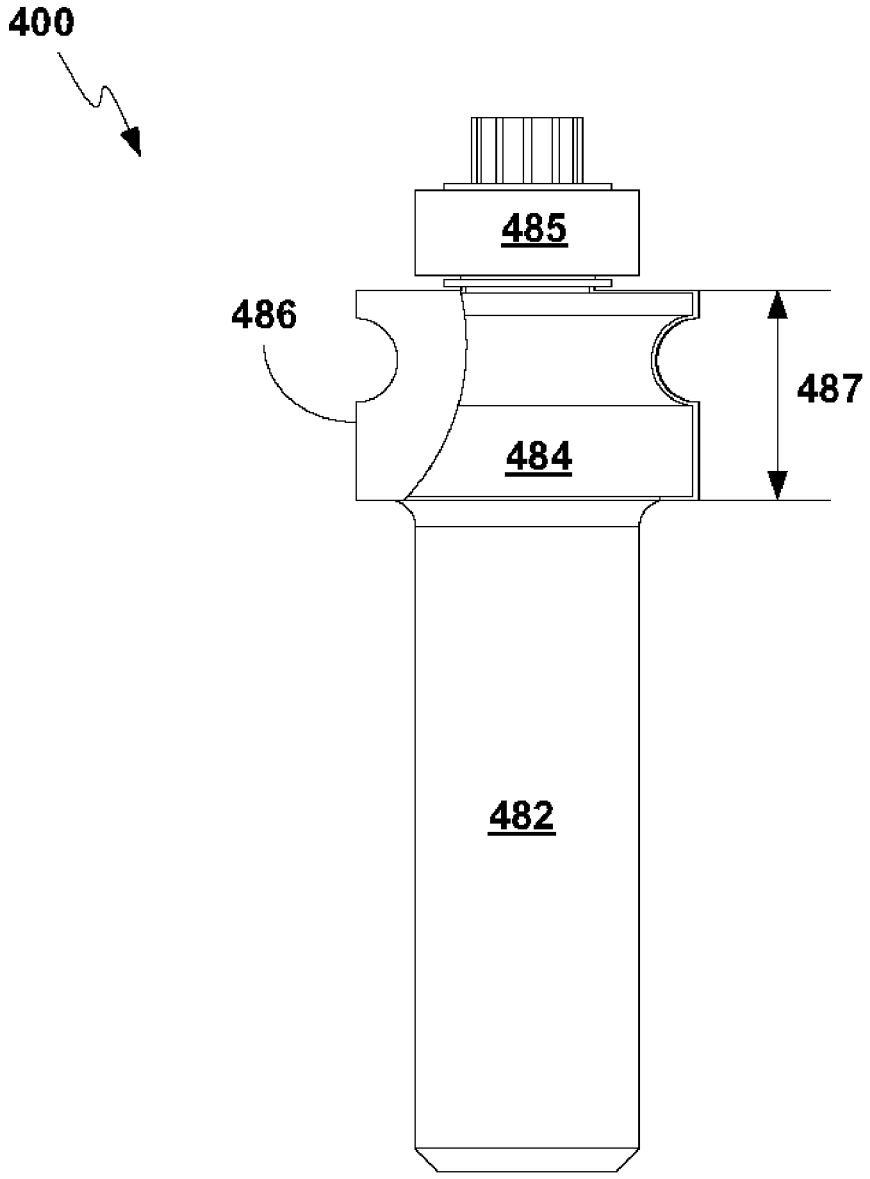
FIG. 10 illustrates an exemplary router bit for cutting beaded features along an edge of a workpiece.

FIG. 10 illustrates router bit 400. Router bit 400 is suitable for cutting beaded features along an edge of a workpiece. For example, router bit 400 may be used to cut the beaded features of center rail 302, top and bottom rails 306 and stiles 304 (FIG. 9).

Router bit 400 includes shaft 482, ball bearing guide 485 and cutting element 484. Cutting element 484 includes a cutting edge 486, which provides the profile of beaded features for workpieces of a beaded face frame.

Cutting edge 486 has a height 487. Height 487 may be configured to match height 87 of rotary bit 80, which facilitates simple positioning of rotary bit 80 relative to a beaded workpiece cut by router bit 400. As an example, height 487 may be between 0 and 2 inches. As other examples, height 487 may be approximately 0.125 inches, 0.25 inches, 0.375 inches, 0.5 inches, 0.75 inches, 1.0 inch, 1.5 inches, 2.0 inches or another height.

It can be particularly useful for height 487 to be a precise nominal value, such as 0.250 inches. For example, providing router bit 400 with a precise nominal height 487 of 0.250 inches facilitates the production of workpieces having beaded features with nominal widths of 0.250 inches. For rotary bit 80 (FIG. 4), the length 38 of distal side 81 should be precisely the width of a workpiece minus twice the width of a beaded feature of the workpiece. If length 38 is to have a nominal value, than the beaded features of a workpiece should also have precise nominal widths. For example, if a width of a workpiece is 1.500 inches, and the workpiece includes beaded features with widths of 0.250 inches, than length 38 of rotary bit 80 should be 1.000 inches. In such an example, rotary bit 80 may also be used for workpieces having widths greater than 1.500 inches by using two or more cutting motions.

In order to simply the production of beaded face frames, a rotary bit, such as rotary bit 80 may be included in a kit with a router bit suitable for cutting beaded features along an edge of a workpiece, such as router bit 400. Optionally, the kit may also include a machinery fence support facilitating fence movement in a direction perpendicular to a length of the fence. In such a kit, height 487 of router bit 400 may be substantially equal to height 87 of rotary bit 80. In addition, length 38 of rotary bit 80 may correspond to a standard nominal workpiece width, minus twice of height 487.

Other kit configurations may also be used. For example, a single rotary bit 80 may be included with a plurality of router bits configured to cut beaded features of different widths, e.g., 0.125 inches, 0.250 inches, 0.375 inches, 0.500 inches, 0.625 inches, 0.750 inches, 1.000 inches etc. In such an example, height 87 of rotary bit 80 should be at least as large as the height of the largest router bit. Prior to a cutting operation to form a notch, such as notch 340 (FIG. 8), rotary bit 80 should be set to a height that is substantially the same as the width of the beaded features of the workpiece. By using router bits with precise nominal heights to cut beaded features with precise nominal widths, the proper positioning of rotary bit 80 relative to a workpiece can be easily determined, especially when cutting a notch requires using two or more cuts, i.e., when the notch is to be wider than rotary bit 80.

Various examples of this disclosure have been described. These and other examples are within the scope of the following claims.

The invention claimed is:

1. A woodworking kit for cutting a beaded face frame in a workpiece, said workpiece having a width and a face and extending a length between opposing ends; said kit comprising:

at least one rotary bit having a distal end and a proximal end;

at least one router bit having a distal end and a proximal end;

said rotary bit having a shaft adjacent said rotary bit distal end and a cutting element adjacent said rotary bit proximal end;

said router bit having a shaft adjacent said router bit distal end and a cutting element adjacent said router bit proximal end;

said rotary bit having a trapezoidal profile for cutting a notch in the workpiece;

said router bit having a profile for cutting a decorative beaded feature;

wherein as the trapezoidal profile of the cutting element of the rotary bit extends from said rotary bit distal end to said rotary bit proximal end the cutting element extends from a first width to a narrower second width; and wherein the first width of the cutting element of the rotary bit corresponds to the width of the workpiece.

2. The woodworking kit of claim 1 wherein the profile of the cutting element of the rotary bit is symmetric.

3. The woodworking kit of claim 1 wherein the profile of the cutting element of the router bit is symmetric.

4. The woodworking kit of claim 1 further comprising a bearing connected to the router bit.

5. The woodworking kit of claim 1 further comprising a bearing connected to the router bit adjacent the proximal end.

6. The woodworking kit of claim 1 wherein the second width of the cutting element of the rotary bit corresponds to the width of the workpiece minus twice the width of the beaded feature of the router bit.

7. The woodworking kit of claim 1 wherein the cutting element of the rotary bit extends a height from its distal end to its proximal end;

wherein the cutting element of the router bit extends a height from its distal end to its proximal end;

wherein the height of the rotary bit corresponds to the height of the router bit.

8. A woodworking kit for cutting a beaded face frame in a workpiece, said workpiece having a width and a face and extending a length between opposing ends; said kit comprising:

at least one rotary bit having a distal end and a proximal end;

at least one router bit having a distal end and a proximal end;

said rotary bit having a shaft adjacent said rotary bit distal end and a cutting element adjacent said rotary bit proximal end;

said router bit having a shaft adjacent said router bit distal end and a cutting element adjacent said router bit proximal end;

said rotary bit having a trapezoidal profile for cutting a notch in the workpiece;

said router bit having a profile for cutting a decorative beaded feature;

wherein as the trapezoidal profile of the cutting element of the rotary bit extends from said rotary bit distal end to said rotary bit proximal end the cutting element extends from a first width to a narrower second width; and wherein the second width of the cutting element of the rotary bit corresponds to the width of the workpiece minus twice the width of the beaded feature of the router bit.

9. The woodworking kit of claim 8 wherein the profile of the cutting element of the rotary bit is symmetric.

10. The woodworking kit of claim 8 wherein the profile of the cutting element of the router bit is symmetric.

11. The woodworking kit of claim 8 further comprising a bearing connected to the router bit.

12. The woodworking kit of claim 8 further comprising a bearing connected to the router bit adjacent the proximal end.

13. The woodworking kit of claim 8 wherein the first width of the cutting element of the rotary bit corresponds to the width of the workpiece.

14. The woodworking kit of claim 8 wherein the cutting element of the rotary bit extends a height from its distal end to its proximal end;

wherein the cutting element of the router bit extends a height from its distal end to its proximal end;

wherein the height of the rotary bit corresponds to the height of the router bit.

* * * * *